US005564571A

United States Patent [19]

Zanotti

[11] Patent Number: 5,564,571

[45] Date of Patent: Oct. 15, 1996

[54] STRIP FOR ELECTRICAL CONNECTORS

[75] Inventor: Aurelio Zanotti, Brescia, Italy

[73] Assignee: Cembre S.p.A., Brescia, Italy

[21] Appl. No.: 458,161

[22] Filed: Jun. 2, 1995

Related U.S. Application Data

[63] Continuation of Ser. No. 221,607, Apr. 1, 1994, abandoned.

[30] Foreign Application Priority Data

Jul. 19, 1993 [IT] Italy ..... MI93A1589

[51] Int. Cl.[6] ..... B65D 73/02

[52] U.S. Cl. ..... 206/716; 206/486; 206/493

[58] Field of Search ..... 206/713, 714, 206/716, 725, 726, 493, 345, 347, 479, 485, 487, 488, 489

[56] References Cited

U.S. PATENT DOCUMENTS

| | | | |
|---|---|---|---|
| 3,339,719 | 9/1967 | Bush | 206/716 |
| 3,439,798 | 4/1969 | James | 206/488 X |
| 3,517,803 | 6/1970 | Frompovicz | 206/330 |
| 3,920,121 | 11/1975 | Miller | 206/330 |
| 4,586,610 | 5/1986 | Gandolfo | 206/485 |
| 4,757,895 | 7/1988 | Gelzer | 206/330 |
| 4,761,086 | 8/1988 | Peterpaul | 206/345 X |
| 5,119,934 | 6/1992 | Karasawa et al. | 206/330 |

FOREIGN PATENT DOCUMENTS

| | | | |
|---|---|---|---|
| 0439940 | 8/1991 | European Pat. Off. . | |
| 0501392 | 9/1992 | European Pat. Off. . | |
| 2527615 | 1/1977 | Germany . | |
| 0219760 | 9/1990 | Japan | 206/330 |

*Primary Examiner*—Bryon P. Gehman
*Attorney, Agent, or Firm*—Guido Modiano; Albert Josif

[57] ABSTRACT

Flexible strip on which the electrical connectors are arranged at uniform intervals and placed mechanically without the aid of adhesive substances and/or fixing elements. The strip has, at uniform distances, openings in which the electrical connectors are placed; the contour of the openings is studied so as to ensure simple and reliable containment of the connector and an equally easy and immediate extraction thereof. The contours blanked in the flexible strip are mostly provided, at their ends, with oppositely arranged protrusions that face the mostly circular openings of the connectors in order to retain them. Other mostly circular openings are blanked in the flexible strip at a constant pitch, mostly alternated with the openings for positioning the electrical connectors, and are used for the traction and positioning of the strip in the apparatus for automatically fixing the connector to the electrical conductor.

10 Claims, 1 Drawing Sheet

STRIP FOR ELECTRICAL CONNECTORS

This is a continuation application of application Ser. No. 08/221,607 filed on Apr. 1, 1994, now abandoned.

BACKGROUND OF THE INVENTION

The present invention relates to a strip for electrical connectors.

As is known, electrical connectors having the most disparate shapes and suitable for various types for electrical connection are already commercially available and are supplied loose, for individual application; one of the most popular electrical connectors is the terminal in which the stem is electrically insulated by PVC or nylon tubular sheets, and the present invention relates mainly to these.

The increasingly frequent use of automatic devices for applying connectors has led to the need to uniformly join said connectors with a strip-like configuration, so as to provide coils or ribbons which are easily insertable in the loading units of automatic application machines.

Some of the known solutions use a strip for insulated electrical connectors which is constituted by a plurality of insulated connectors arranged side by side and mutually joined by means of a ribbon which is formed monolithically with the insulating sleeve and consequently provides continuity despite offering the possibility of easily folding the strip.

With this type of arrangement, first of all there are considerable problems during pressing, since the joining ribbon and the sleeve must be formed monolithically, with consequent complications of the die, and secondly the automatic machine for applying the terminal must have blanking means to blank the ribbon during application.

Other solutions already in use entail the fixing for electrical connectors to a flexible strip with additional materials such as staples, adhesive tapes or glues, etcetera.

SUMMARY OF THE INVENTION

The aim of the present invention is to solve the problems described above by providing a strip for electrical connectors that allows to automatically load application machines by mutually joining the various connectors with a uniform spacing, without using complicated dies to provide the connection.

Within the scope of this aim, a particular object of the invention is to provide a strip for electrical connectors in which it is possible to join, in an orderly manner and with uniform spacing, a plurality of conventional-type electrical connectors manufactured entirely according to conventional techniques.

Another object of the present invention is to provide a strip for electrical connectors which, by virtue of its particular constructive characteristics, is capable of giving the greatest assurances of reliability and safety in use.

Another object of the present invention is to provide a strip for electrical connectors, particularly pre-insulated terminals, which can be easily obtained starting from commonly commercially available elements and materials and is furthermore competitive from a merely economical point of view.

With this aim in view, as well as these and other objects which will become apparent hereinafter, there is provided, according to the present invention, a strip for electrical connectors, particularly pre-insulated terminals, characterized in that it comprises a band of material which is flexible at least along its longitudinal extension and forms a plurality of mutually parallel and spaced openings having, in two oppositely arranged points, protrusions that can detachably engage the axial ends of the sleeve of a terminal and the like to detachably retain a plurality of mutually spaced terminals arranged side by side.

BRIEF DESCRIPTION OF THE DRAWINGS

Further characteristics and advantages of the strip for electrical connectors according to the present invention, will become apparent from the following detailed description of a preferred but not exclusive embodiment thereof, illustrated only by way of non-limitative example in the accompanying drawings, wherein.

DESCRIPTION OF THE PREFERRED EMBODIMENTS

Figure 1:
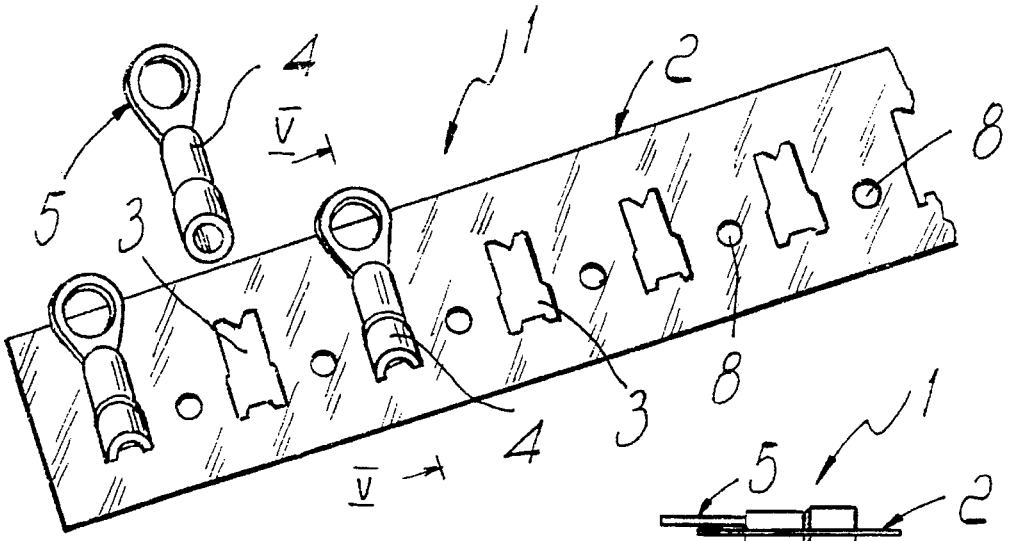
FIG. 1 is a schematic perspective view of the strip for insulated electrical connectors according to the invention.
Figure 2:
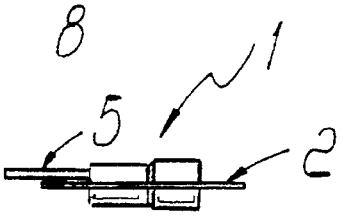
FIG. 2 is a view of the strip, taken from one of its ends.
Figure 3:
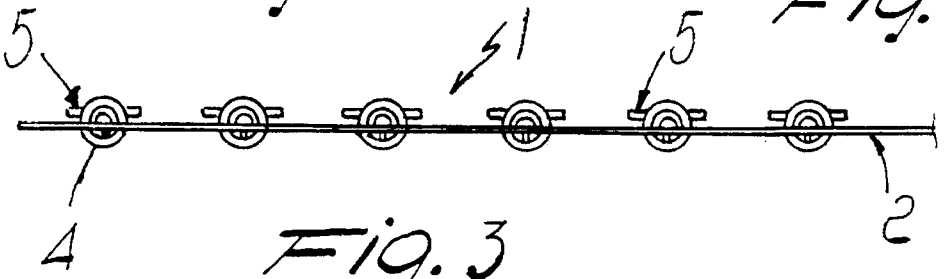
FIG. 3 is a front elevation view of the strip.
Figure 4:
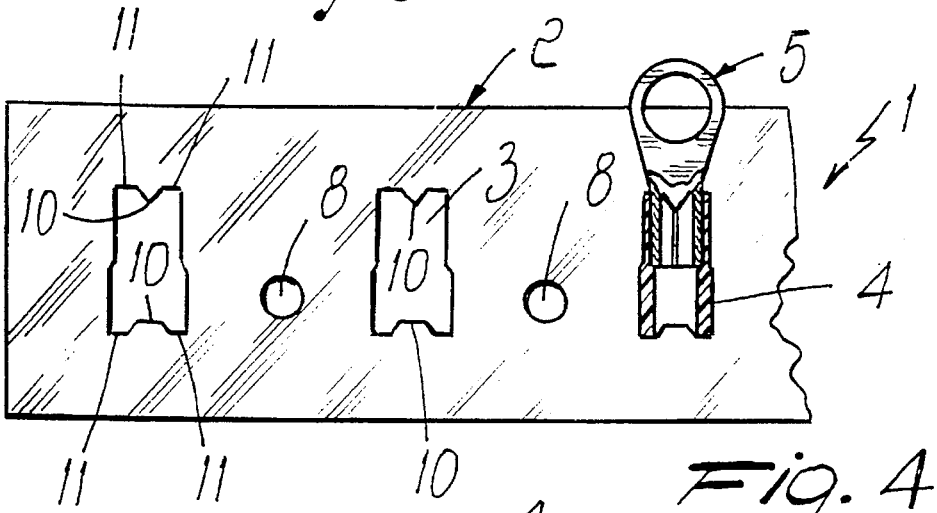
FIG. 4 is a schematic view of the strip, illustrating a terminal in sectional view.
Figure 5:
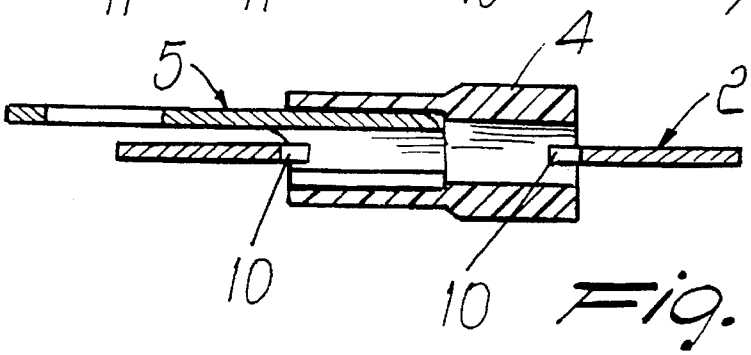
FIG. 5 is a sectional view, taken along the plane V—V of FIG. 1.

With reference to the above figures, the strip for electrical connectors, particularly pre-insulated terminals, according to the invention, which is generally designated by the reference numeral 1, comprises a band 2 which is advantageously made of relatively flexible plastic material, so as to allow flexibility at least along the longitudinal extension of said band.

Advantageously but not necessarily, said band is made of optically transparent material.

The band 2 has a plurality of equidistant openings 3 having a shape that is substantially complementary to the outer surface of the insulating sleeve 4 of a connector or terminal, generally designated by the reference numeral 5.

The openings 3 are arranged mutually side by side and at a uniform distance from one another, and are furthermore arranged mutually parallel so that their axis is preferably at right angles to the longitudinal extension of the band 2.

Equally equidistant perforations 8 may be provided between the openings 3 and have the purpose of allowing engagement with the means for jogging the strip and positioning the electrical connectors in the device for clinching them on the conductors.

An important particularity of the present invention resides in the fact that at two oppositely arranged points so of the openings 3 there are protrusions 10 having the purpose of engaging inside the axial ends of the insulating sleeve 4, retaining said sleeve and consequently the connectors in position, with the possibility of easily extracting said connectors.

Advantageously, the protrusions 10 are shaped so as to form, laterally to them, indentations designated by the reference numeral 11 that facilitate the centering of the sleeve in the openings 3.

With this arrangement it is thus possible to provide a strip for electrical connectors simply by applying on the band 2 conventional insulated electrical connectors which are inserted by pressing, so as to obtain the insertion of the protrusions 10 at the axial ends of the sleeve.

In a similar manner, during extraction it is sufficient to apply force in the extraction direction to disengage the protrusions 10 from the axial ends of the sleeves and consequently release them.

From what has been described above it is thus evident that the present invention achieves the intended aim and objects, and in particular the fact is stressed that a strip is provided that allows to join in an orderly manner, at constant distances and mutually side by side, a plurality of conventional-type electrical connectors, thus allowing to provide loading units of a length that can vary in each instance according to the requirements for application to automatic machines.

The invention thus conceived is susceptible to numerous modifications and variations, all of which are within the scope of the inventive concept.

All the details may furthermore be replaced with other technically equivalent elements.

In practice, the materials employed, as well as the contingent shapes and dimensions, may be any according to the requirements.

What is claimed is:

1. In combination, a strip for pre-insulated terminals each having a stem and a plurality of sleeves each for containing a respective terminal, wherein said strip is made of a material which is flexible at least along its longitudinal extension and forms a plurality of mutually parallel and spaced openings each having an elongated shape with an axis, each opening of said openings having, at two oppositely arranged points, a protrusion to define a pair of protrusions that detachably engage the axial ends of a respective sleeve of said sleeves to detachably retain a plurality of mutually spaced terminals arranged side by side, each said sleeve being tubularly shaped and adapted to accommodate the stem of one said terminal.

2. Combination according to claim 1, wherein the axis of each of said openings is arranged substantially at right angles to the longitudinal extension of said strip.

3. Combination according to claim 2, wherein each pair of protrusions is arranged substantially on the axis of its respective opening.

4. Combination according to claim 1, wherein each of said openings has a shape that is substantially complementary to the outer surface of a respective sleeve of said sleeves.

5. Combination according to claim 1, wherein said protrusions extend laterally with respect to said strip with each protrusion defined by indentations for engagement with the axial edges of one of said sleeves.

6. In combination, a strip for pre-insulated terminals each having a stem and a plurality of sleeves each for containing a respective terminal, wherein said strip is made of a material which is flexible at least along its longitudinal extension and forms a plurality of mutually parallel and spaced openings each having an elongated shape with an axis, each opening of said openings having, at two oppositely arranged points, a protrusion to define a pair of protrusions that detachably engage the axial ends of a respective sleeve of said sleeves to detachably retain a plurality of mutually spaced terminals arranged side by side, each said sleeve being tubularly shaped and adapted to accommodate the stem of one said terminal, said strip further comprising uniformly spaced single perforations arranged between said openings which allow for engaging means for jogging said strip.

7. Combination according to claim 6, wherein the axis of each of said openings is arranged substantially at right angles to the longitudinal extension of said strip.

8. Combination according to claim 7, wherein each pair of protrusions is arranged substantially on the axis of its respective opening.

9. Combination according to claim 6, wherein each of said openings has a shape that is substantially complementary to the outer surface of a respective sleeve of said sleeves.

10. Combination according to claim 6, wherein said protrusions extend laterally with respect to said strip with each protrusion defined by indentations for engagement with the axial edges of one of said sleeves.

* * * * *